US005248146A

United States Patent [19]

Viets et al.

[11] Patent Number: 5,248,146

[45] Date of Patent: Sep. 28, 1993

[54] PUTTING TRAINER DEVICE

[75] Inventors: Alan Viets, East Granby; Thomas Frechette; Richard Frechette, both of Windsor Locks, all of Conn.

[73] Assignee: Perfect Putt, Inc., East Granby, Conn.

[21] Appl. No.: 857,473

[22] Filed: Mar. 25, 1992

[51] Int. Cl.[5] ..... A63B 69/36

[52] U.S. Cl. ..... 273/189 R; 273/192; 273/166

[58] Field of Search ..... 273/189 R, 189 A, 187.2, 273/191 B, 191 R, 192, 165, 166

[56] References Cited

U.S. PATENT DOCUMENTS 4,944,516 7/1990 Bickler ..... 273/165 X 5,145,179 9/1992 Breed ..... 273/189 R

OTHER PUBLICATIONS

"Golf Digest", Nov. 1974, p. 68.

*Primary Examiner*—George J. Marlo

*Attorney, Agent, or Firm*—Fishman, Dionne & Cantor

[57] ABSTRACT

A putting trainer device is presented. The putting trainer device comprises a plate having an inverted U-channel depending angularly from each end. An elastic band or strap is disposed about each channel. The plate preferably has a hole wherein an attachment pin is inserted for attaching the plate to one end of a putter. The plate is formed to a predetermined length to assure proper spacing of the golfer's arm during training. Further, each channel depends from predetermined angles to assure proper positioning of the golfer's arms and wrist.

15 Claims, 3 Drawing Sheets

PUTTING TRAINER DEVICE

BACKGROUND OF THE INVENTION

The present invention relates to teaching aids for improving golf strokes. More particularly, the present invention relates to a device for teaching proper alignment of the golfers arms and wrist during putting and chipping.

When putting, the position of the feet, hand grip, arms and shoulders are all important. Also of importance is the actual putting stroke. The stroke must be smooth in both the back and forward movement and lie in the plane of the desired initial path of the ball. A common problem is movement of the putter's wrist inconsistent with the putters arm and shoulders. This flipping of the wrists in the back or forward movement fails to result in a smooth stroke.

The prior art has attempted to address this problem with the training device of U.S. Pat. No. 4,944,516 to Bickler. The device of U.S. Pat. No. 4,944,516 comprises a J-hook having a pin which hole engages a at the top of a putter. Further, an angled member extends from the lower portion of the J-hook at a predetermined angle. The lower portion of the J-hook is disposed adjacent to the grip of the putter on which the device is attached. The other end of the angled member includes a U-shaped member for engaging one of the putter's forearms. However, the device of U.S. Pat. No. 4,944,516 allows the putter's wrist to flip or hinge (i.e., the wrist to move inconsistently with respect to the arms and shoulders) during the back swing. Therefore, the device of U.S. Pat. No. 4,944,516 does not promote a smooth swing during both the back and forward swing. Also, the portion of the J-hook adjacent to the putter grip requires the golfer to grip the device as well as the club (i.e., the putter). This can lead to an unnatural orientation of the golfer's grip and excessive grip pressure (i.e., to support the device). This unnatural grip is likely to negatively affect the golfer's game during actual play (when not practicing with the device).

Another prior art training device is disclosed in U.S. Pat. No. 2,273,416 to Norwood. The device of U.S. Pat. No. 2,273,416 comprises a guide member which rests against the shaft of the club and has an extension therefrom which terminates in a band which fastens around a single wrist of the golfer. With the device attached to the wrist of the rear arm and the member in contact with the golf shaft, the shape and dimensions of the device are such that the device attempts to achieve proper positioning of the club, wrists and hands of the golfer.

However, this device suffers from the same problems as the device of U.S. Pat. No. 4,944,516 discussed above. The device of U.S. Pat. No. 2,273,416 will allow the golfer's wrist to flip or hinge during the back stroke of a putt.

Other prior art training devices for putting include U.S. Pat. Nos. 4,133,535, 4,252,317 and 4,998,731. This list is provided by way of example and is not intended to be an exhaustive list of such prior art devices.

SUMMARY OF THE INVENTION

The above-discussed and other problems and deficiencies of the prior art are overcome or alleviated by the putting trainer device of the present invention. In accordance with the present invention, a plate having an inverted U-channel depending angularly from each end is presented. An elastic band or strap is disposed about each channel. The plate preferably has a hole wherein an attachment pin is inserted for attaching the plate to one end of a putter. However, other means for attaching the plate to the putter may be employed. The plate is formed to a predetermined length to assure proper spacing of the golfer's arm during training. Further, each channel depends from predetermined angles to assure proper positioning of the golfer's arms and wrist. One of the channels is larger than the other, since it is to be located further up the golfer's arm. This attachment of the putter to the plate also assures proper positioning during practice putting.

Accordingly, the putting trainer device of the present invention provides three points of support, i.e., each arm and the point at which the putter is attached to the device. This results in the arm, hands and putter operated in a unified relationship. Moreover, the larger muscles of the golfer (i.e., the forearms, upper arms and shoulders) now control the stroke and not the golfer's wrist or hands. This results in pendulum motion for the stroke. This is the preferred golf stroke when putting.

The present invention promotes a consistent feel and motion, which aid in eliminating the desire to control the Putting stroke with the golfer's hands or wrist. Once this proper relationship of the arms, wrist, hands and putter are learned, more control over the putting stroke can be achieved. The device of this invention also improves the golfer's control over chip shots.

The present invention provides significant advantages over the prior art, since there are three points of support, the golfer's wrist are not allowed to flip or hinge during either the back swing or forward swing. Also, a natural and correct grip on the putter can be maintained even while training with the device of the present invention, since the golfer's hands do not secure the device, as is required in the prior art device of U.S. Pat. No. 4,944,516.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
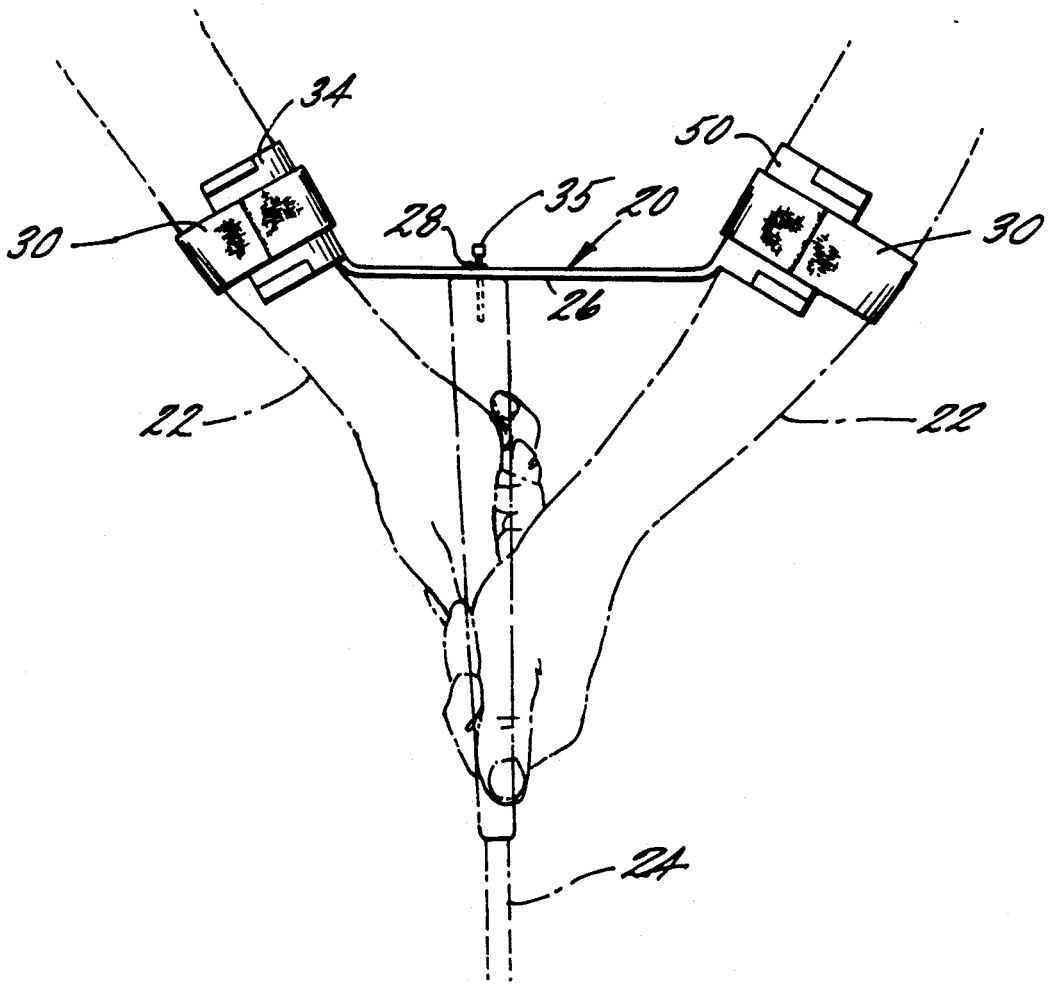
FIG. 1 is a side elevational view of the putting trainer device secured about a golfer's arms, shown in phantom, and attached to a putter, shown in phantom, in accordance with the present invention.

Referring to FIG. 1, a putting trainer device 20 is shown secured about a golfer's arms 22 and attached to a putter 24. The device 20 is depicted for use by a left handed individual, although it will be understood this is for illustrational purposes only. Device 20 comprises a plate 26 having attachment means 28 for attaching plate 26 to one end of putter 24. Further, arm support means 30 are disposed at each end of plate 26.

Referring now to FIGS. 2-4 and 9-11, plate 26 has a plurality of holes 32 extending therethrough. An attachment pin 35 (FIG. 1) is to be disposed in one of the holes 32 and secured in a hole generally found at the end of the grip of putter 24. However, other means for attaching plate 26 to putter 24 may be employed. Pin 35 may be angled (for example, between 8°-12°) relative to plate 26; or in a preferred embodiment, pin 35 will be transverse (e.g. 90 degrees) relative to plate 26.

A first inverted U-channel 34 depends generally upwardly and outwardly from one end of plate 26. Channel 34 comprises a base 36 and opposing sides 38. Opposing pairs of retainer tabs 40 and 42 extend outwardly from sides 38 of channel 34.

Figure 8:
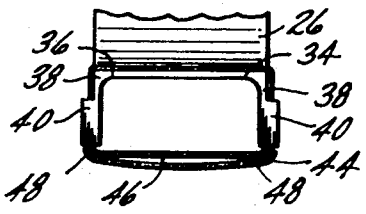
FIG. 8 is an angled partial top view of the end shown in FIG. 7.
Figure 7:
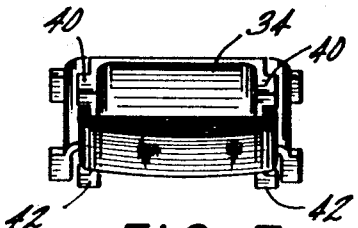
FIG. 7 is an end view taken along the line 7—7 of FIG. 2.
Figure 3:
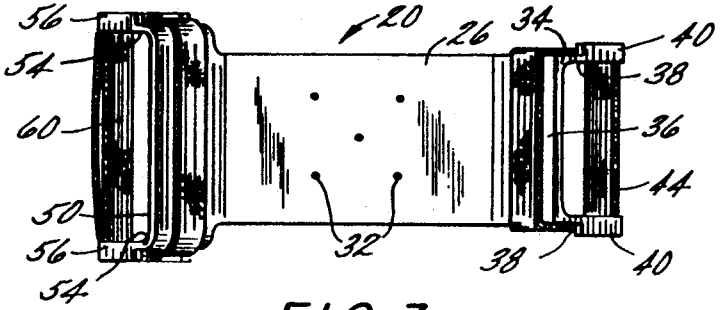
FIG. 3 is a top view of the putting trainer device of FIG. 1.
Figure 2:
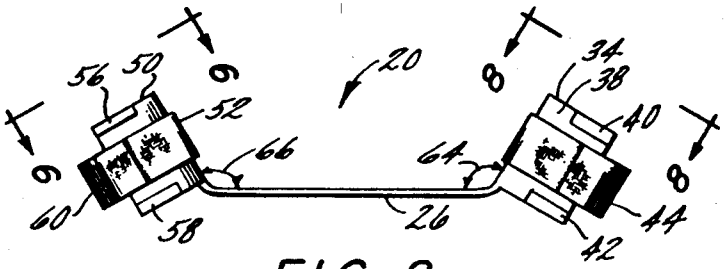
FIG. 2 is a side elevational view of the putting trainer device of FIG. 1.
Figure 4:
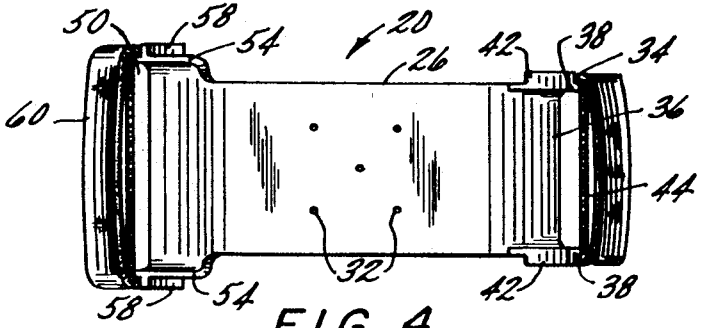
FIG. 4 is a bottom view of the putting trainer device of FIG. 1.

Also referring to FIGS. 7 and 8, a first strap or band 44 is disposed about channel 34. Band 44 includes a loop 46 for securing channel 34 of device 20 to a forearm 22 (FIG. 1) of a golfer. Band 44 is preferably comprised of an elastic material to provide a secure fit and to allow band 44 to be secured about forearms of many sizes. Loop 46 may be formed by twice wrapping a single continuous piece of material about channel 34 and attaching each loose end to the adjacent material (e.g., by ultrasonic welding, sewing, tape or a loop and hook type attachment). Then adjacent material at points designated 48 are attached, as described above, to form loop 46. Also two loops of material could be disposed one on top of the other about channel 34 and the adjacent material attached at points 48, as described above, to form loop 46. Further, a single loop of material could be disposed about channel 34 and a second piece of material attached at points 48, as described above, to form loop 46. Retainer tabs 40 and 42 retain band 44 about channel 34 as is clearly show in FIG. 7.

Again referring to FIGS. 2-4 and 9-11, a second inverted U-channel 50 depends generally upwardly and outwardly from the other end of plate 26. Channel 50 comprises a base 52 and opposing sides 54. Opposing pairs of retainer tabs 56 and 58 extend outwardly from sides 54 of channel 50.

Figure 6:
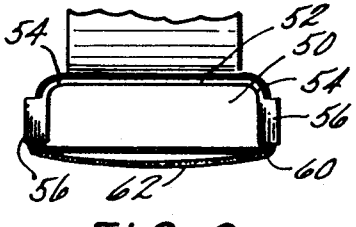
FIG. 6 is an angled partial top view of the end shown in FIG. 5.
Figure 5:
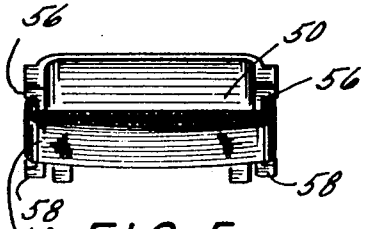
FIG. 5 is an end view taken along with line 5—5 of FIG. 2.
Figure 10:
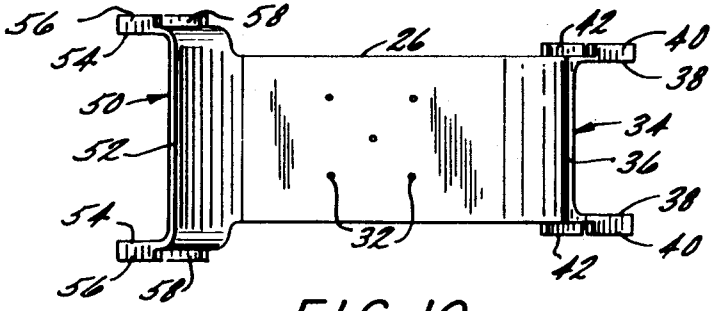
FIG. 10 is the view of FIG. 3 with the straps removed.
Figure 9:
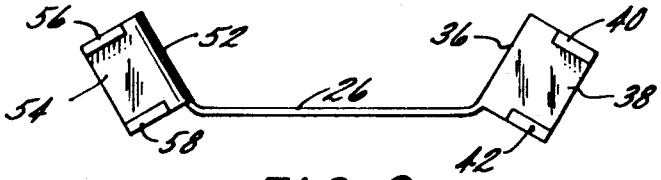
FIG. 9 is the view of FIG. 2 with the straps removed.
Figure 11:
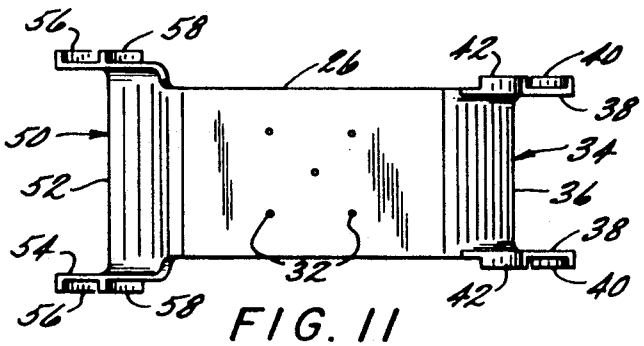
FIG. 11 is the view of FIG. 4 with the straps removed.

Also, referring to FIGS. 5 and 6, a second strap or band 60 is disposed about channel 50. Band 60 includes a loop 62 for securing channel 50 of device 20 to a forearm 22 (FIG. 1) of a golfer. Band 60 is preferably comprised of an elastic material to provide a secure fit and to allow band 60 to be secured about forearms of many sizes. Loop 62 is formed in the same manner as loop 46 described hereinbefore.

Channel 50 is preferably larger than channel 34 since it is located further up the golfer's arm as is clearly shown in FIG. 1. Generally a person's arm has a larger diameter further up the arm. The reason channel 50 is located further up the arm than channel 34 is a result of one hand being disposed below the other with proper hand positioning. Since, channels 34 and 50 are not located at the same portions of the golfer's arms the angle for each is different. Channel 34 is at an angle 64 (FIG. 2) with respect to plate 26. Angle 64 is preferably between 120°-135° and 120° is the preferred angle 64. Channel 50 is at an angle 66 (FIG. 2) with respect to plate 26. Angle 66 is preferably between 120°-125° and 120° is the preferred angle 66. These angles were found to best fit most golfer's, however angles 64 and 66 may be varied to accommodate a particular person.

Preferably device 20 is comprised of a single continuous piece of plastic. This can be accomplished by plastic injection molding, plastic machining, cutting and forming a plastic sheet under heat or other known methods.

Foam pads (not shown) may be secured within channels 34 and 50 to provide a cushion between the golfer's arm and device 20. The foam pads will be preferably larger than the corresponding channels 34 and 50 to avoid contact with the edges of the channels.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A device for use with a putter by an individual to aid in learning a proper putting stroke, comprising:
   - a plate of a predetermined length having first and second opposing ends;
   - a first inverted U-shaped channel depending generally upwardly and outwardly from said first end of said plate for fitting to a first forearm of said individual, said first channel having a base and a pair of opposing sides;
   - a second inverted U-shaped channel depending generally upwardly and outwardly from said second end of said plate for fitting to a second forearm of said individual, said second channel having a base and a pair of opposing sides; and
   - means for attaching said plate to one end of said putter.

2. The device of claim 1, wherein said means for attaching comprises:
   - said plate including at least one hole extending therethrough; and
   - an attachment pin retained at one end to said plate and extending through said hole for attachment at the other end to one end of the putter, whereby said plate is attached to the putter.

3. The device of claim 2 wherein said attachment pin extends from said plate at an angle between 8° and 12°.

4. The device of claim 2 wherein said attachment pin extends from said plate at an angle of about 90 degrees.

5. The device of claim 1 further comprising:
   - first and second strap means disposed about said corresponding first and second channels.

6. The device of claim 5 wherein said first and second strap means each include a loop.

7. The device of claim 5 further comprising:
   - means for retaining said first and second strap means about said corresponding first and second channels.

8. The device of claim 7 wherein said means for retaining comprises:
   - a plurality of retainer tabs depending outwardly from each of said sides of each of said first and second channels, wherein said first and second strap means are retained on said corresponding first and second channels between said retainer tabs.

9. The device of claim 5 wherein said first and second strap means are each comprised of an elastic material.

10. The device of claim 1 wherein said first channel depends from said plate at an angle between 120° and 125°; and wherein said second channel depends from said plate at an angle between 120° and 135°.

11. The device of claim 1 further comprising pad means disposed in each of said first and second channels.

12. The device of claim 1 wherein one of said first and second channels is larger than the other.

13. A device for use with a putter to aid in learning a proper putting stroke, comprising:

a plate of a predetermined length having first and second opposing ends;

attachment means for attaching said plate to one end of the putter; and first and second arm support means disposed at corresponding first and second ends, each of said first and second arm support means for supporting a portion of each corresponding arm of a golfer, wherein the golfer's arms are positioned for the proper putting stroke.

14. The device of claim 13 further comprising:

retaining means for retaining said first and second arm support means at the golfer's corresponding arms.

15. The device of claim 13 said first and second arm support means each comprise an inverted U-channel.

* * * * *